United States Patent [19]

Bianchi et al.

[11] 4,172,433

[45] Oct. 30, 1979

[54] PROCESS AND APPARATUS FOR FUEL-MIXTURE PREPARATION

[75] Inventors: Valerio Bianchi, Hochdorf; Reinhard Latsch, Vaihingen; Ernst Linder, Muhlacker; Gerhard Kistner, Moglingen; Helmut Maurer; Herbert Schindler, both of Schwieberdingen, all of Fed. Rep. of Germany

[73] Assignee: Robert Bosch GmbH, Stuttgart, Fed. Rep. of Germany

[21] Appl. No.: 638,021

[22] Filed: Dec. 5, 1975

[30] Foreign Application Priority Data

Dec. 5, 1974 [DE] Fed. Rep. of Germany ..... 2457436

[51] Int. Cl.[2] ..... F02B 3/00

[52] U.S. Cl. ..... 123/32 EA; 123/32 EE; 123/32 EB

[58] Field of Search ..... 123/32 EE, 32 EB, 32 EA, 123/119 EC

[56] References Cited

U.S. PATENT DOCUMENTS

| | | | |
|---|---|---|---|
| 3,789,816 | 2/1974 | Taplin | 123/32 EA |
| 3,895,611 | 7/1975 | Endo | 123/32 EE |
| 3,898,962 | 8/1975 | Honig | 123/32 EB |
| 3,906,207 | 9/1975 | Rivere | 123/32 EE |
| 3,911,872 | 10/1975 | Hughes | 123/32 EB |

*Primary Examiner*—Ronald B. Cox
*Attorney, Agent, or Firm*—Edwin E. Greigg

[57] ABSTRACT

A fuel metering system of an internal combustion engine is regulated by a data processor which has stored data prescribing the proper amount of fuel to be metered out for particular positions of the throttle valve and for particular values of the engine rpm. This preliminary adjustment is further refined by providing the data processor with feedback data concerning actual engine operating parameters, e.g. the exhaust gas composition, engine speed fluctuation and temperature. The feedback data is used by the data processor to override and further adjust the fuel quantity metered out to the engine.

4 Claims, 5 Drawing Figures

PROCESS AND APPARATUS FOR FUEL-MIXTURE PREPARATION

BACKGROUND OF THE INVENTION

The invention relates to a process for mixture preparation in a mixture-compressing externally ignited internal combustion engine in which the fuel metering takes place in dependence on the throttle valve position and the engine rpm. The fuel metering can be performed by carburetors or by fuel injection valves.

Mixture-compressing internal combustion engines must be supplied with the proper amount of fuel corresponding to the aspirated air quantity for each and every power stroke of the engine. The amount of fuel must be such that the combustion produces adequate power but operates without an excess of fuel since that results in an intolerably high degree of toxic components.

For these reasons, it is desired to supply a combustion fuel-air mixture is either at the stoichiometric ratio, where the air number $\lambda$ equals 1.0 or lies in a region in which there is an excess of air ($\lambda > 1.0$); the latter condition is particularly suitable to reduce toxic exhaust gas components so as to permit compliance with constantly more rigorous requirements with respect to atmospheric purity. In the following discussion, the mixture preparation system will be understood to be a fuel injection system. In order to correctly adjust the duration of fuel injection, the air quantity aspirated by the engine must be known exactly. This knowledge may be derived from measurement of the air flow rate in the induction tube of the engine, for example by means of a baffle plate which is displaced against a restoring force and serves to adjust appropriate metering means coupled thereto. Unfortunately, this is a relatively expensive process which, furthermore, suffers from the inherent disadvantage that the changes in the filling factor of the cylinder and hence, e.g. the increase of the engine torque, are delayed with respect to the opening of the throttle valve, due to the inertia of the air flow measuring member.

Instead of making an air flow rate measurement, it is also possible to set the fuel injection duration on the basis of the engine rpm and the induction tube pressure. By following the characteristic curve of an induction tube pressure sensor, the correct amount of fuel as a function of induction tube pressure for a particular rpm may be determined.

Induction tube pressure measurements are, however, quite complicated, and, just as in the baffle plate measurement, additional sensors are required. Furthermore, as in the air flow rate measurement, there is a delay in the fuel metering with respect to the changes in air aspiration. A supplementary mechanism is required to achieve a temporary enrichment during a change of the throttle valve position so as to obtain a good transition from one state to the next.

It is relatively simple to obtain a clear signal as to the position of the throttle valve, for example by coupling a suitable potentiometer thereto and, whereas the induction tube pressure changes are delayed with respect to the opening of the throttle valve, the fuel quantity changes at the same time as the throttle valve position. Thus, it is particularly advantageous to determine the fuel injection duration on the basis of the throttle valve position and the rpm. The rpm and the throttle valve positions can also be used to permit an unambiguous indication of the required fuel quantity for each power stroke and this process is also known.

A known characteristic set of curves for a process of this type is shown schematically in FIG. 2 and will be discussed in more detail below. Unfortunately, the fuel injection quantity depends on the rpm and the throttle valve position in a relatively complicated manner. In the function $t_i = f(x,n)$, shown in FIG. 2, $t_i$ is the time during which fuel is injected to a cylinder per power stroke and is therefore proportional to the fuel quantity Q. Since the above mentioned function f is difficult to follow in a direct manner, a known circuit uses a low pass filter in a pulse-shaping circuit to transform this function into a somewhat simpler function which is easier to follow, and this simpler function is subsequently multiplied by another rpm-dependent function. This known method also entails a substantial expense.

OBJECT AND SUMMARY OF THE INVENTION

It is, therefore, a first principal object of the invention to provide a process to determine the fuel quantity metered out to an internal combustion engine which permits, without substantial expense, to determine the fuel quantity on the basis of the throttle valve position and the rpm of the internal combustion engine in a precise manner.

It is another principal object of the invention to provide an apparatus for carrying out the process according to the invention.

The first principal object of the invention is based on the known process described above and provides that the apparatus which stores the set of data curves that determine the amount of fuel as a function of the rpm and the throttle valve position is also supplied with feedback signals related to the engine behavior, so as to superimpose a refinement on the relatively coarse pre-control based on the stored set of data curves. An advantage of this provision is that the stored set of data curves need be followed only approximately so that this characteristic forward control can be regarded as a coarse pre-control process, whereas the closed control loop permits a sensitive and precise regulation.

The invention makes use of the characteristic data in the set of stored curves which, for each individual internal combustion engine, determine the appropriate values for determining the fuel injection time, but the invention goes beyond this relatively coarse control method, as already explained, by applying additional signals to a suitable data processor. These signals are related to the actual engine behavior and the feedback control signals provided to the data processor result in a closed control loop in which the engine itself is the controlled variable.

The control signals can be individual signals or, preferably, combined signals which supply the data processor with data concerning the actual engine behavior and which are superimposed on the characteristic data set so that the operation of the internal combustion engine is continuously controlled.

The invention will be better understood as well as further objects and advantages thereof will become more apparent from a detailed description of a preferred embodiment taken in conjunction with the drawing.

DESCRIPTION OF THE PREFERRED EMBODIMENT

Figure 1:
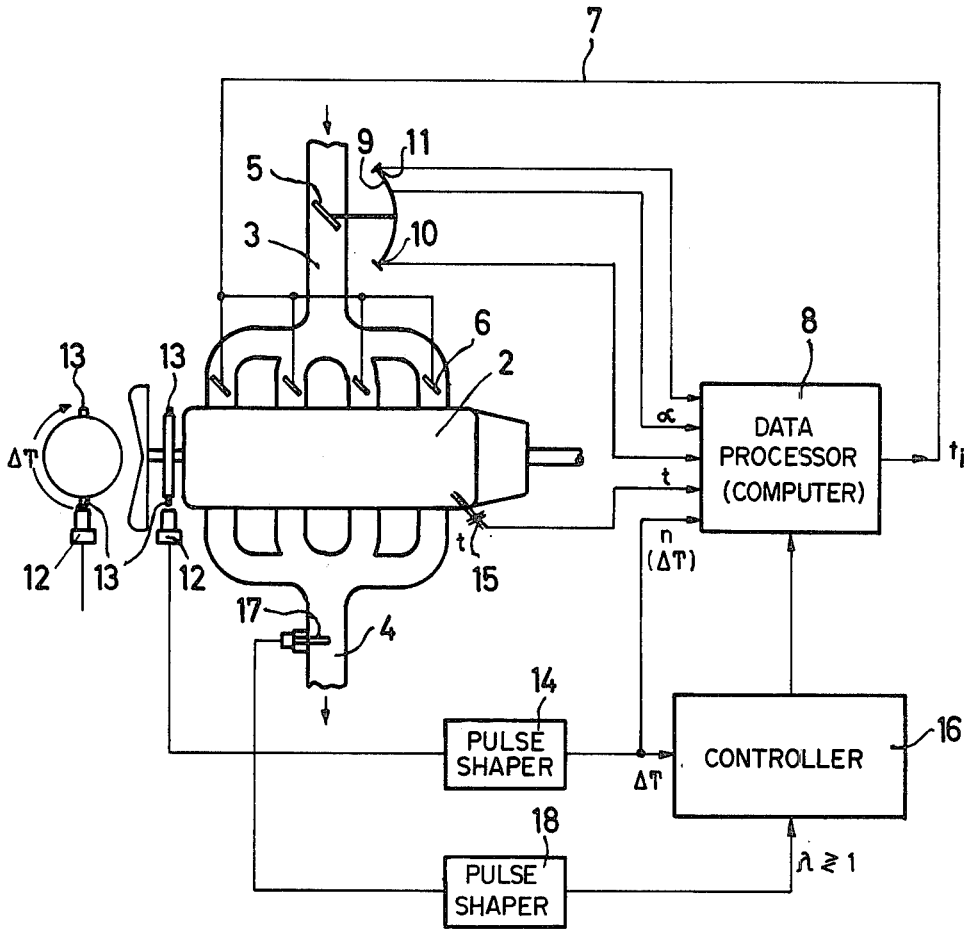
FIG. 1 is an overall schematic diagram of the engine and associated control circuitry.

Turning now to FIG. 1, there is shown an engine 2 which is to be supplied with fuel metered out to each injection valve for a duration $t_i$. The engine is supplied with combustion air via a schematically indicated induction manifold 3 and expels the combusted exhaust gases through an exhaust line 4. Located within the induction tube 3 is a throttle valve 5 which is actuated by gas pedal linkage (not shown). In the region of the inlet valves, the induction manifold includes separate injection valves 6, one for each cylinder, which are controlled electrically by a common line 7 leading to a data processor 8 to be described below. The injection valves 6 receive fuel through separate supply lines, a pump and a filter from a pressurizing fuel circuit, all not shown, and this fuel is injected by the injection valve 6 into the appropriate regions of the induction tube in the vicinity of the cylinders during a time-period determined by the data processor 8.

Figure 2:
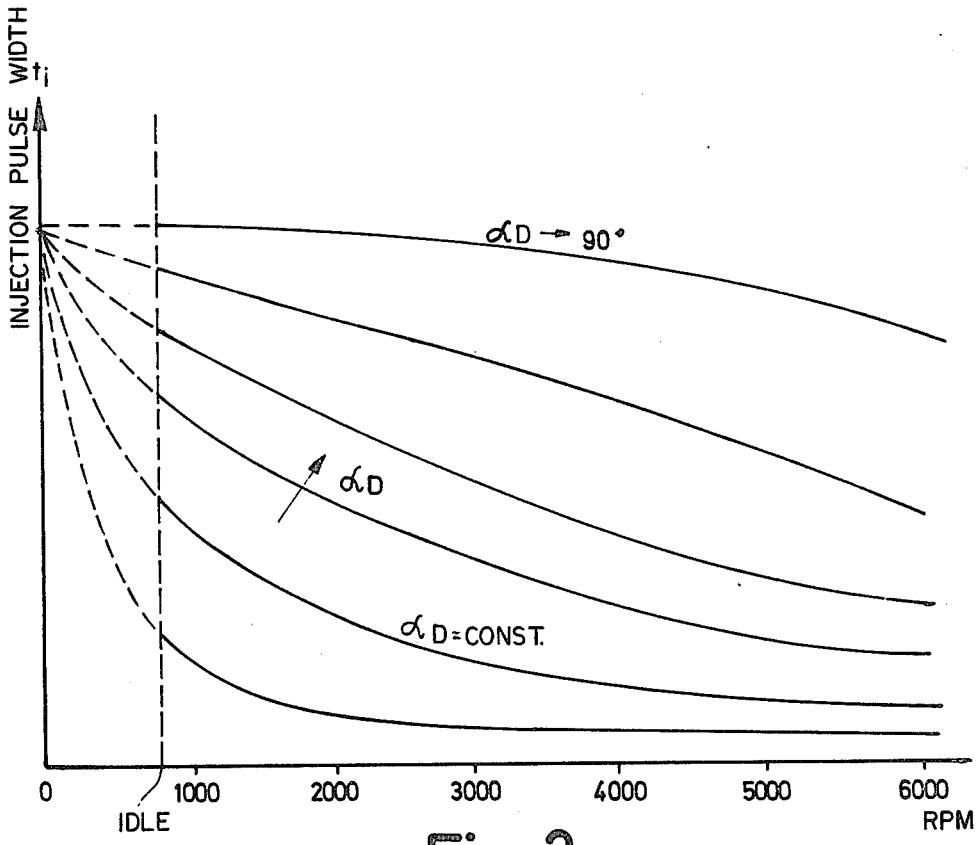
FIG. 2 is a diagram of a specific characteristic set of curves for a particular internal combustion engine, showing the dependence of the fuel injection time on the rpm for various throttle valve positions.

FIG. 2 shows the above-mentioned specific characteristic set of curves for a particular internal combustion engine. The set of curves shows the ordinate $t_i$ as the injection period per stroke, i.e., the injected fuel quantity, as a function of the rpm, plotted along the abscissa. The different curves are associated with different, constant throttle valve positions. It will be seen that, at low rpm, a relatively small change in the throttle valve position results in a relatively large change of the injected fuel quantity whereas, at high rpm, a small throttle valve change results in only a very small change of the injected fuel quantity although large throttle valve changes still cause considerable changes in fuel consumption. Common experience verifies that the basic character of this set of curves is correct: at low engine rpm, only small changes in the throttle valve are necessary to cause the engine to change its torque characteristics considerably, whereas, at high rpm, only very substantial throttle valve changes result in any noticeable change in the operating conditions of an internal combustion engine.

It has already been mentioned above that a characteristic set of curves, such as in FIG. 2, is specific to a particular type of internal combustion engine and does not change during its operation, so that a set of curves of this type may be obtained once and for all by measurement for each engine or engine type. Once the curves have been determined, these data are stored in the data processor, i.e., the data processor has instructions to deliver injection pulses of a particular duration through the injection valve 6 via the line 7 at any particular rpm and throttle valve position, all in accordance with the characteristic set of curves. The input data are obtained, according to FIG. 1, with the aid of a potentiometer 9 associated with the throttle valve 5 and this potentiometer circuit may also include a full load switch 10 and/or an idling switch 11 so that these particular operational states may generate special signals which are also fed to the data processor 8. Furthermore, the data processor is supplied with an rpm signal, obtained in known manner, for example from the ignition pulses or, as shown in the exemplary embodiment of FIG. 1, with the aid of a sensor 12 which, preferably inductively, senses the passage of a marker 13 associated with the crankshaft. This signal is proportional to the engine rpm and may be fed to the data processor 8, for example after passage through a pulse-shaping stage 14, as an rpm-related or a period-related signal. The sensor 12 is preferably also used to determine the degree of quiet running of the engine, i.e., the engine speed fluctuation; it is, in fact, primarily intended for this purpose and delivers the rpm signal only incidentally, as will be discussed further blow.

Finally, the data processor receives a signal t, related to the cylinder head temperature or the cooling water temperature, which is obtained by a sensor 15 and serves to provide suitable conditions during cold starting and warmup of the engine.

Based on these data, the data processor 8 provides the injection pulse $t_i$ with the aid of the set of characteristic curves, such as those in FIG. 2. However, this selection is only a relatively coarse pre-control and, for this reason, it is an important feature of the invention to provide a controller 16 which checks the operation of the data processor 8 by measuring the actual engine behavior and which, by preferably multiplicative engagement of the data processor, ensures a flawless and especially a clean operation of the engine with favorable fuel consumption.

Figure 3:
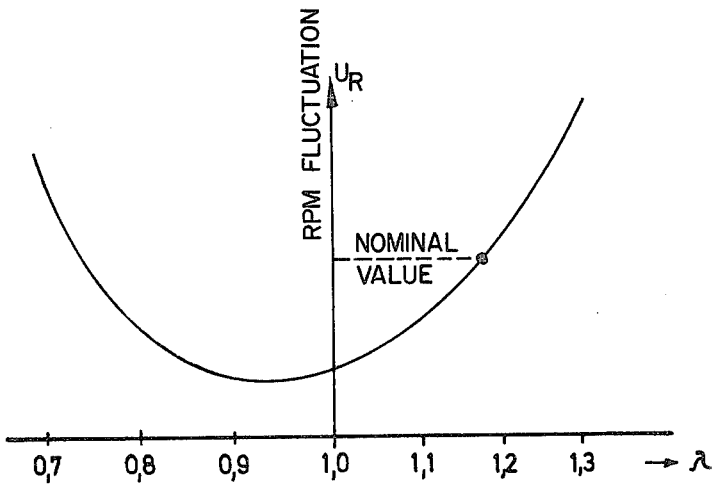
FIG. 3 shows the control voltage $U_r$ of a particular controller as a function of the air number λ.

For this purpose, in a first exemplary embodiment of the invention, the controller 16 is supplied with a signal from a sensor 17 which monitors the exhaust gas conditions of the internal combustion engine. It is a normalized function of the sensor output and its numerical value can be greater than, equal to or smaller than the numerical value 1. This signal corresponds to the air number λ which is related to the ratio of the combustion air to the fuel. The sensor 17 is so located in the exhaust pipe that it is able to determine whether the combustion mixture fed to the engine is stoichiometric or whether it contains excess air or fuel. Such sensors are known per se, so that a detailed description is unnecessary. It is also known, as shown in FIG. 3, that the engine speed fluctuations (which are proportional to the control voltage $U_r$ shown in FIG. 3) increase for increasingly lean mixtures ($\lambda > 1$) until, finally, the mixture is incapable of sustaining combustion.

If λ is equal to 1.0, corresponding to the desired stoichiometric ratio, or if there is a small excess of fuel, the engine runs very smoothly ($U_r$ small); the speed fluctuations again increase for a rich mixture. It is to be understood that the internal combustion engine should not be operated at all in the region where λ is much less than 1, because a very rich mixture is harmful to the environment and also results in high fuel consumption. For this reason, the controller 16 is so designed that the output signals fed to the data processor 8 are such that the air number λ is held constant and approximately equal to 1 or greater than 1.

The term "$\lambda = 1$ control process" which will be used below means, in principle, that a particular value λ min is maintained in the control process and that this value is constant and is close to unity (1.0). In actual fact, however, the air number λ depends somewhat on the particular operational and rpm conditions of the engine, such as idling partial-load or a full load, and λ can attain values at least slightly different from 1.0.

As a variant, instead of sensing the exhaust gas conditions in the exhaust manifold, one may sense the speed fluctuations of the internal combustion engine since, as has already been explained, the speed fluctuations are also a function of the chemical components in the fuel-air mixture.

As mentioned above, engine speed fluctuations are detected by a preferably inductive sensor 12 which produces pulses proportional to the crank shaft rotation. Irregular engine operation, i.e., speed fluctuations, result in changes in the relative rotation of the crankshaft and, in irregular operation, these changes may exceed a permissible threshhold when compared to previous values so that a rough-running engine is thereby signalled. The measurement of the engine speed fluctuations is also a known method and is not described in greater detail here. What is substantial is that a signal may be obtained that can be fed to the controller 16 and hence, to the data processor 8, in such a manner that the engine speed fluctuations are regulated within a predetermined range of values by suitable adjustment of the fuel injection pulse duration.

This process presents the difficulty that, when only speed fluctuations of the engine are used as the control value, the engine may also be operated in the region where $\lambda<1$, as seen from FIG. 3, inasmuch as the function $U_r$ extends to both sides of the value $\lambda=1.0$. To avoid this ambiguity, there is provided, in addition to the regulation based on speed fluctuations, a so-called "$\lambda=1$ control" which takes precedence over these speed fluctuations when $\lambda\leqq 1$. In other words, the controller 16 is so designed that, when it uses engine speed fluctuation control, i.e., when it uses signals derived with the aid of a sensor checking the engine behavior, these signals are used only if, at the same time, the engine operates in the hyperstoichiometric region of mixture, i.e., where $dUR/d\lambda>0$, so that a stable control process is possible.

Most advantageously, a combination of engine speed fluctuation control and "$\lambda=1$ control" is used because, in that case, the engine can be operated smoothly and reliably with a stoichiometric or leaner fuel-air mixture, permitting a flawless adaptation to all operational engine domains.

Figure 4:
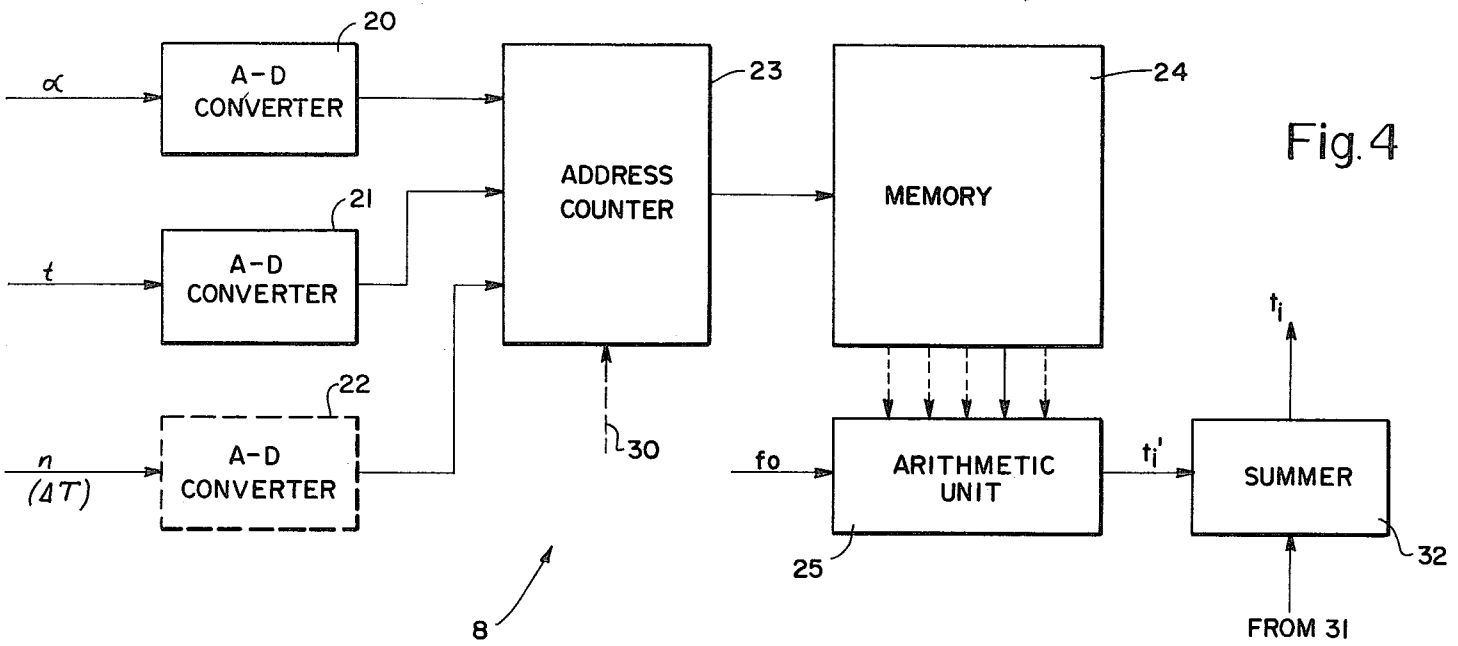
FIG. 4 is a block diagram of an embodiment of the data processor 8.

The data processor mentioned above may e.g. comprise a system working on a digital basis. In this case the input values corresponding to the rpm-signal, the throttle valve position signal $\alpha$ and the temperature signal t may first be converted, see FIG. 4, into digital values by known analog to digital converters 20–22. The output signals of these converters may be corresponding frequencies $f\alpha$, $f_t$, $f_n$ being then delivered to an address generating device which may be an address counter 23 known in the art. The address counter 33 combines the received input frequencies by cyclically sensing the delivered frequencies and generated a corresponding single address which may be delivered to a memory device, e.g. a PROM or ROM. Depending on the storage capacity of memory 24 a corresponding binary word is issued by the memory in which for each special type of engine the data corresponding to the mentioned curves $ti=f(\alpha, rpm)$ are stored.

By a second counter 25 receiving a constant counting frequency fo, the binary word cyclically issued by the memory may be converted into a time interval or period for example by counting the received work down to zero thereby controlling a switching device e.g. a flip-flop set by the beginning of the counting cycle and reset when receiving the zero counting position. This time period may be designated by ti and represents already at least a coarse value of the injection period per stroke.

Figure 5:
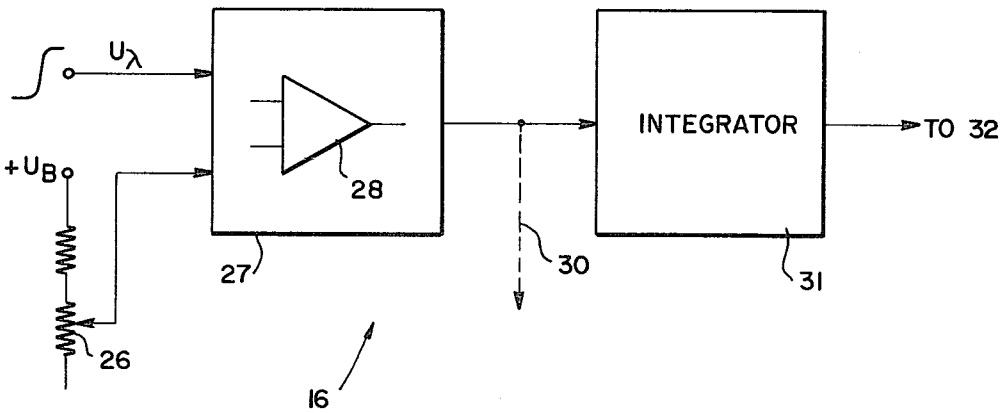
FIG. 5 is a schematic circuit diagram of an embodiment of the controller 16.

As mentioned above the injection period thereby obtained is subsequently checked or corrected by a controller 16 in correspondence to the actual engine behaviour. The controller 16 is shown in FIG. 5 and includes, as diagrammatically indicated, a threshold establishing means 27 comprising in this case a voltage divider 26 and a differential amplifier 28. The other imput of the amplifier receives the voltage created by the oxygen sensor or λ-sensor, said voltage being more or less a step function. Consequently the output signal of amplifier 28 is either on a relative high level or on a low level depending on the input values, the reference voltage delivered by divider 26 and the step function of sensor 17.

This amplifier output signal is additionally used to improve the injection period generated by counter 25.

A first possibility for combining the sensor output signal with the operation of the data processor may comprise delivering the amplifier output signal directly to the address counter as indicated by reference numeral 30 thereby enabling the counter to improve and correct the address delivered to the memory circuit. This method is especially effective provided that there is sufficient storage capacity.

A further method would comprise delivering the amplifier output signal to an integrating circuit 31; the continuously increasing and decreasing integrator output voltage may then be delivered to a summing circuit 32 creating the corrected and true value of ti.

The summing circuit 32 may comprise multiplier means for achieving a multiplicative mixture of the introduced analog data. Such devices are known in the art, they may comprise monostable flip-flop means whereby the charging and discharging current of the feedback capacitor is influenced by the received signals to be combined.

What is claimed is:

1. A method of preparing the fuel-air mixture for a mixture compressing, externally ignited, internal combustion engine, comprising the steps of:

(A) compiling a set of data associating optimum fuel quantities with pairs of values of throttle valve opening and of engine rpm, respectively, and storing said set of data in a data processor;

(B) providing said data processor with a signal representative of actual throttle valve opening;

(C) providing said data processor with a signal representative of actual engine rpm;

(D) providing said data processor with feedback data representative of actual engine preformance which includes monitoring the engine speed fluctuation and providing said data processor with a signal representative thereof via a controller; whereby said data processor controls the injection pulse duration to maintain a predetermined value of the engine speed fluctuation; and (E) monitoring the fuel-air conditions in the exhaust channel of the engine (λ-measurement) and providing said controller with a signal representative thereof; whereby the controller superimposes said signal representative of said fuel-air conditions on said signal representative of engine fluctuation whenever the fuel-air conditions are substoichiometric ($\lambda$ less than 1);

whereby said data processor controls the fuel metering to said internal combustion engine on the basis of said compiled set of data, said signals and said engine performance feedback data in the manner of closed control loop.

2. A method of preparing the fuel-air mixture for a mixture compressing, externally ignited, internal combustion engine, comprising the steps of:

(A) compiling a set of data associating optimum fuel quantities with pairs of values of throttle valve opening and of engine rpm, respectively, and storing said set of data in a data processor;

(B) providing said data processor with a signal representative of actual throttle valve opening;

(C) providing said data processor with a signal representative of actual engine rpm;

(D) providing said data processor with feedback data representative of actual engine performance which includes monitoring the engine speed fluctuation and providing said data processor with a signal representative thereof via a controller; whereby said data processor controls the injection pulse duration to maintain a predetermined value of the engine speed fluctuation; and (E) monitoring the fuel-air conditions in the exhaust channel of the engine ($\lambda$-measurement) and providing said controller with a representative signal which is the only signal transmitted by the controller to said data processor, the range $\lambda<1$ being prohibited;

whereby said data processor controls the fuel metering to said internal combustion engine on the basis of said compiled set of data, said signals and said engine performance feedback data in the manner of closed control loop.

3. An apparatus for fuel injection pulse timing of an internal combustion engine, said engine including an induction manifold, an exhaust manifold, a throttle valve and fuel injection valves, said apparatus comprising:

(A) rpm sensor means;

(B) throttle valve position sensor means;

(C) data processor means, including means for storing data relating the duration of the injection pulse to numerical values of rpm and of the throttle valve position and connected to receive signals from said rpm sensor means and from said throttle valve position sensor means for providing a pulse of controlled duration for operating the fuel injection valves of the engine;

(D) exhaust gas sensor means, located in the exhaust manifold;

(E) controller means, for receiving signals from said exhaust gas sensor means for providing a feedback control signal to said data processor means; and (F) engine speed fluctuation sensor means, connected to said data processor, for providing a feedback signal for maintaining engine operation at desired values of engine speed fluctuation whereby the induction manifold, the engine and the exhaust manifold together constitute the controlled variable of a control loop whose feedback signals are said signals from said exhaust gas sensor means.

4. An apparatus as claimed in claim 3, wherein said controller means is so constructed that when the actual value of $\lambda$ as measured by said exhaust gas sensor means lies below a predetermined value, said controller means operates the engine at the predetermined value of $\lambda$.

* * * * *